US007108201B2

(12) United States Patent
Fischer et al.

(10) Patent No.: US 7,108,201 B2
(45) Date of Patent: Sep. 19, 2006

(54) INJECTION VALVE

(75) Inventors: Bernhard Fischer, Töging A. Inn (DE); Bernhard Gottlieb, München (DE); Andreas Kappel, Brunnthal (DE); Tim Schwebel, München (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/010,587

(22) Filed: Dec. 13, 2004

(65) Prior Publication Data

US 2005/0092854 A1 May 5, 2005

Related U.S. Application Data

(63) Continuation of application No. PCT/DE03/02185, filed on Jul. 1, 2003.

(30) Foreign Application Priority Data

Jul. 18, 2002 (DE) ..... 102 32 693

(51) Int. Cl.

| | |
|---|---|
| ***F02M 47/02*** | (2006.01) |
| ***F02M 41/16*** | (2006.01) |
| ***F02M 59/00*** | (2006.01) |
| ***B05B 1/30*** | (2006.01) |

(52) U.S. Cl. ..... 239/88; 239/89; 239/91; 239/93; 239/533.1; 239/533.2; 239/533.14; 239/585.1

(58) Field of Classification Search ..... 239/88, 239/89, 91, 93, 533.1, 533.2, 533.3, 533.7, 239/533.14, 585.1, 585.3, 585.4, 585.5
See application file for complete search history.

(56) References Cited

U.S. PATENT DOCUMENTS

| | | | | |
|---|---|---|---|---|
| 4,350,301 | A * | 9/1982 | Erwin et al. | 239/453 |
| 4,588,132 | A * | 5/1986 | Neitz et al. | 239/453 |
| 5,090,625 | A * | 2/1992 | Davis | 239/453 |
| 5,685,492 | A | 11/1997 | Davis et al. | 239/584 |
| 5,878,961 | A * | 3/1999 | Mueller et al. | 239/453 |
| 6,105,879 | A * | 8/2000 | Potz et al. | 239/88 |

FOREIGN PATENT DOCUMENTS

| | | |
|---|---|---|
| DE | 475 116 | 4/1929 |
| DE | 100 12 969 A1 | 11/2001 |

* cited by examiner

*Primary Examiner*—Davis Hwu
(74) *Attorney, Agent, or Firm*—Baker Botts L.L.P.

(57) ABSTRACT

The injector tip of an injection valve which injects directly into the combustion chamber protrudes therein, thereby incurring the risk that combustion residues can become deposited on the injector tip. When the injection valve is in a closed state, the possible attachments of combustion residues along a separation line (10) are eliminated by means of a special configuration of the surface at the separation line (10) between the valve body and a valve plate. The surface is represented in a smooth, step-less, edge-less and curved manner.

19 Claims, 1 Drawing Sheet

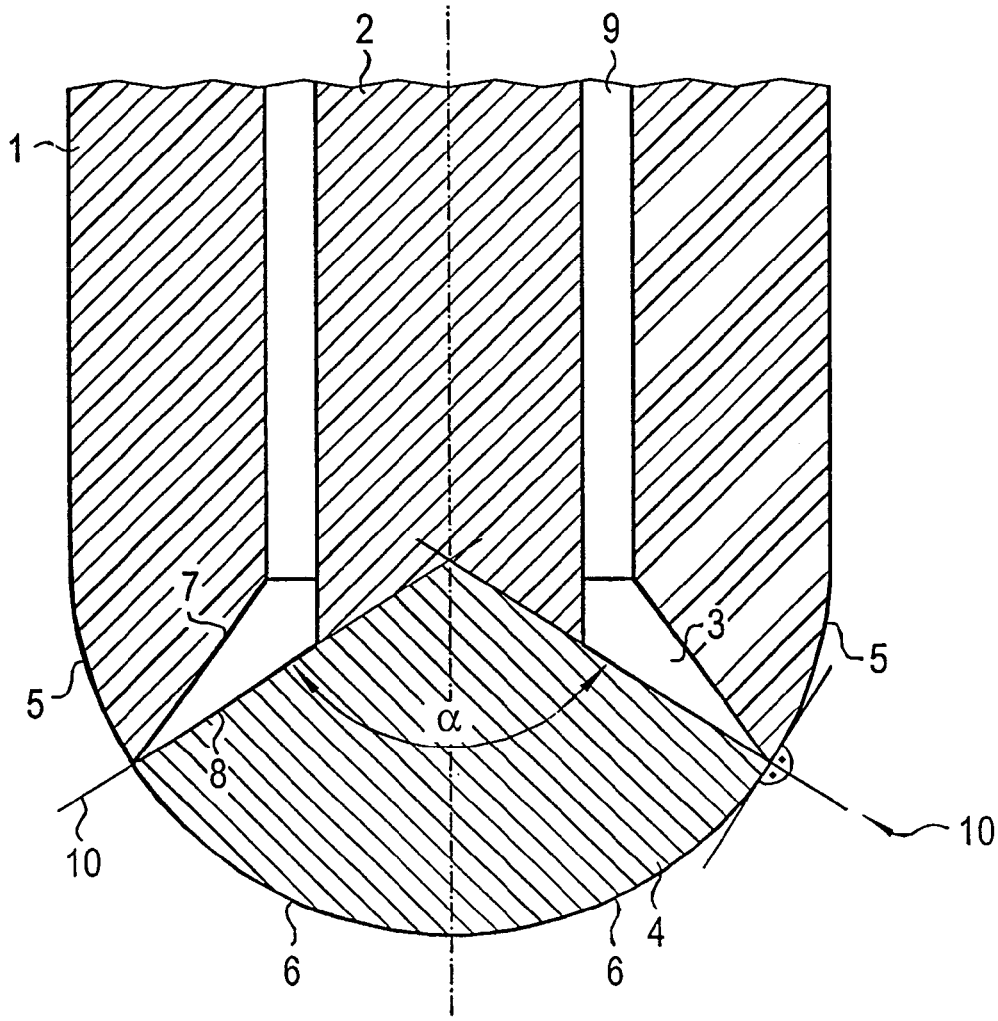
2
9
1
7
3
5
5
α
8
10
10
6
6
4

INJECTION VALVE

CROSS REFERENCE TO RELATED APPLICATION

This application is a continuation of copending International Application No. PCT/DE03/02185 filed Jul. 1, 2003 which designates the United States, and claims priority to German application no. 102 32 693.2 filed Jul. 18, 2002.

TECHNICAL FIELD OF THE INVENTION

The present invention relates to an injection valve, in particular its injection tip, which protrudes into a combustion chamber for direct injection into said combustion chamber. There is a risk with this construction that combustion residues can be deposited on the injector tip. Deposits which settle particularly in proximity to the fuel outlet gap, influence the geometry of the discharging cone spray, in particular the shape of the angle of taper of the spray and the coherence of the spray. Spray-controlled combustion methods are however based on the precise reproducibility of injection processes within narrow tolerance ranges over the entire service life of the motor, so that the formation of deposits has to be prevented.

DESCRIPTION OF THE RELATED ART

German patent application DE A 100 12 969 discloses an injection nozzle which is inserted into the cylinder head of an internal combustion engine. The injection nozzle is moved by means of a control element, whereby a sealing element is opened and closed correspondingly. In the closed state, the surfaces of the sealing body and the injection nozzle form a common planar surface.

The effect of this design is to prevent the collection and settling of combustion residues in the region of the nozzle outlet. To this end a common planar surface is formed at the front face of the housing of the injection nozzle with the sealing body when the injection nozzle is in a closed state, so that the surface of the injection nozzle and the sealing body facing the combustion chamber should remain free of combustion residues, particularly with a tapered lateral surface. The prevention of deposits of combustion residues on the surface of the injector tip cannot however be optimized by means of just a planar surface.

SUMMARY OF THE INVENTION

The object of the invention is to describe an injection valve, at the tip of which deposits of combustion residues are prevented in the region of the fluid outlet.

This object can be achieved by an injection valve which injects directly into a combustion chamber, comprising a valve housing configured as a hollow cylinder comprising a valve seat at the end of the valve housing; an inner coaxial valve needle with a valve plate interacting with the valve seat; and a chamber shown between the valve housing and the valve needle for fuel supply; wherein in the region of a separation line between the valve housing and the valve plate the surfaces of the valve housing and of the valve plate have a common, smooth, stepless, edgeless and at the same time curved surface in the closed state.

The object can also be achieved by an injection valve which injects directly into a combustion chamber, comprising a valve housing having an outer surface configured as a hollow cylinder with a valve seat at the end of the valve housing; an inner coaxial valve needle comprising a valve plate having an outer surface interacting with the valve seat; and a fuel supply chamber between the valve housing and the valve needle; wherein the outer surface of the housing joins the outer surface of the valve plate such that the surfaces of the valve housing and of the valve plate have a common, smooth, stepless, edgeless and at the same time curved surface in the closed state.

The curved surface of the injection valve can be represented by means of a paraboloid, a hyperboloid or an ellipsoid, in particular a spherical cap. The front end of the injection valve can be configured as blunt, for example with a paraboloid end, a hyperboloid end, an ellipsoid end or an end in the shape of a spherical cap. One or a plurality of curvature radii of the surface structure of the tip of the injection valve can be smaller than the radius of the valve housing. For fuel supply purposes, the chamber may join onto an outlet channel, which is bounded by the inner surface of the valve body and the inner surface of the valve plate. The outlet channel can be configured such that the cross-section through which the fuel flows in the flow direction is constant or decreases. A cone spray resulting at the separation line when the valve is open may intersect a tangent to the surfaces of the valve body and the valve plate facing the combustion chamber, vertically or virtually vertically at an angle of approximately 90°±20°.

The invention is based on the knowledge that a common smooth surface, which is stepless and edgeless and curved at the same time, so as to prevent the attachment of combustion residues in the region of the separation line between a valve plate and the valve seat of a valve housing, in other words in the region of the fluid outlet and/or the point of formation of the fluid injection spray. Curvature here refers to outward curvature, which is synonymous with a work-piece radius which is smaller than infinite.

With the invention, the curvature radius of the surface in the region of the separation line is also used as an optimization parameter. The curved surface, which can be in the form of a spherical cap for instance, is particularly advantageous with regard to spray stability and the prevention of deposits of combustion residues on the injection valve and/or at the tip of the injector. Specific adjustment of the curvature radius results in a sustainable influence on the gas flow in proximity to the fuel outlet, which also has a positive effect on spray stability when the injector is open during the injection cycle. Furthermore, the tendency of combustion residues to be deposited when the injector is closed is prevented during the combustion and discharge cycles.

A specially shaped surface configuration at the separation line, for example a paraboloid, ellipsoid or hyperboloid, enables the individual influences within a combustion chamber to be taken into consideration in conjunction with the injector protruding into the combustion chamber and the associated gas flows by means of a correspondingly structural adjustment.

An optimum configuration of an injector tip can therefore be produced in conjunction with the geometry of the outlet channel for the fluid, by means of which cavitation is prevented.

In a further advantageous embodiment of the invention, the resulting cone spray intersects the tangent to the surface of the valve body and the valve plate facing the combustion chamber, when viewed axially, vertically or virtually vertically, preferably at an angle of approximately 90°±20°.

BRIEF DESCRIPTION OF THE DRAWINGS

An exemplary embodiment is described below with reference to a schematic FIGURE.

DETAILED DESCRIPTION OF THE PREFERRED EMBODIMENTS

The FIGURE shows an axial section through the axially symmetrical injector tip facing the combustion chamber. It comprises a valve housing 1 with its surface 5 facing the combustion chamber. Pressurized fuel is fed through a chamber 9 within the injector, said fuel being available at the frontmost end of the injector via an outlet channel 3 connected to the chamber 9. The valve shown here comprises a valve seat on the valve housing 1 corresponding to the inner surface 7 of the valve housing 1 and the inner surface 8 of the valve plate 4 interacting therewith and generates a cone spray when opened. Said spray should be as uniform as possible and not be broken up by combustion deposits which have attached themselves to the outer surface of the injector. The lower end of the valve needle 2 is configured with or connected to the valve plate 4 in a fixed manner. The valve plate 4 has a surface 6 facing the combustion chamber and an inner surface 8 facing the chamber 9. When the injector is in a closed state, the surfaces 5, 6 of the valve body 1 and the valve plate 4 facing the combustion chamber form a common smooth surface without steps or edges. These considerations result respectively in relation to the circumferential separation line 10 between the valve body 1 and the valve plate 4, since combustion residues which could influence the cone spray should be permanently prevented at this location. The surfaces 5, 6 together form a curved surface. A curved surface, as shown in the figure, a spherical cap for example, also allows optimization parameters to be achieved in relation to spray stability as well as the prevention of deposits of combustion residues at this location. The curvature radius allows a sustainable positive influence to be exerted on the gas flow in proximity to the fuel outlet and thus on spray stability when the injector is open during the injection cycle. The same applies to the tendency of combustion residues to be deposited when the injector is closed during the combustion or outlet cycle.

Naturally the shape of the common external contour of the valve body 1 and the valve plate 4 is not restricted to spherical caps, but all surface forms which are easy to manufacture are possible, such as paraboloids, ellipsoids, hyperboloids for instance, if spray stability and the tendency to carbonize can be favourably influenced therewith. A blunt configuration can be provided as the end of the valve tip.

Together with the inner surface 8 of the valve plate 4, the inner surface 7 of the valve body 1 forms the outlet channel 3 for the fuel. The outlet channel 3 of the fuel must be configured such that the cross-section passed through in the flow direction, i.e. from the inside out, is constant or decreases. This ensures that cavitation in the fuel is reliably prevented and that the sealing surface or the sealing line, which is located on the outer edge of the outlet channel 3, is not damaged. The inner surfaces 7, 8 of the valve body 1 and valve plate 4 meet in the flow direction at a flat angle, i.e. either almost parallel or in tangential form when the injector is closed. The tangent direction, shown in the FIGURE as the pattern of the surface 8, determines the cone spray angle $\alpha$.

When the valve is opened, with this configuration any combustion residues deposited in the region of the separation line 10 are broken up and carried away by the high pressure fuel spray, so that any further influence on the cone spray geometry is minimized.

We claim:

1. An injection valve which injects directly into a combustion chamber, comprising a valve housing configured as a hollow cylinder comprising a valve seat at the end of the valve housing;

an inner coaxial valve needle with a valve plate interacting with the valve seat; and a chamber shown between the valve housing and the valve needle for fuel supply;

wherein in the region of a separation line between the valve housing and the valve plate the surfaces of the valve housing and of the valve plate have a common, smooth, stepless, edgeless and at the same time curved surface in the closed state, wherein a cone spray resulting at the separation line when the valve is open intersects a tangent to the surfaces of the valve body and the valve plate facing the combustion chamber, vertically or virtually vertically at an angle of approximately 90°±20°.

2. The injection valve according to claim 1, wherein the curved surface of the injection valve is represented by means of a paraboloid, a hyperboloid or an ellipsoid, in particular a spherical cap.

3. The injection valve according to claim 2, wherein the front end of the injection valve is configured as blunt, for example with a paraboloid end, a hyperboloid end, an ellipsoid end or an end in the shape of a spherical cap.

4. The injection valve according to claim 1, wherein one or a plurality of curvature radii of the surface structure of the tip of the injection valve is smaller than the radius of the valve housing.

5. The injection valve according to claim 1, wherein for fuel supply purposes, the chamber joins onto an outlet channel, which is bounded by the inner surface of the valve body and the inner surface of the valve plate.

6. The injection valve according to claim 5, wherein the outlet channel is configured such that the cross-section through which the fuel flows in the flow direction is constant or decreases.

7. An injection valve which injects directly into a combustion chamber, comprising a valve housing comprising an outer surface configured as a hollow cylinder comprising a valve seat at the end of the valve housing;

an inner coaxial valve needle comprising a valve plate having an outer surface interacting with the valve seat; and a fuel supply chamber between the valve housing and the valve needle;

wherein the outer surface of the housing joins the outer surface of the valve plate such that the surfaces of the valve housing and of the valve plate have a common, smooth, stepless, edgeless and at the same time curved surface in the closed state.

8. The injection valve according to claim 7, wherein the curved surface of the injection valve is represented by means of a paraboloid, a hyperboloid or an ellipsoid, in particular a spherical cap.

9. The injection valve according to claim 8, wherein the front end of the injection valve is configured as blunt, for example with a paraboloid end, a hyperboloid end, an ellipsoid end or an end in the shape of a spherical cap.

10. The injection valve according to claim 7, wherein one or a plurality of curvature radii of the surface structure of the tip of the injection valve is smaller than the radius of the valve housing.

11. The injection valve according to claim 7, wherein the fuel supply chamber joins onto an outlet channel, which is bounded by the inner surface of the valve body and the inner surface of the valve plate.

12. The injection valve according to claim 11, wherein the outlet channel is configured such that the cross-section through which the fuel flows in the flow direction is constant or decreases.

13. The injection valve according to claim 7, wherein a cone spray resulting at a transition of the housing and the valve plate when the valve is open intersects a tangent to the surfaces of the valve body and the valve plate facing the combustion chamber, vertically or virtually vertically at an angle of approximately 90°±20°.

14. An injection valve which injects directly into a combustion chamber, comprising a valve housing comprising an outer surface configured as a hollow cylinder comprising a valve seat at the end of the valve housing;

an inner coaxial valve needle comprising a valve plate having an outer surface interacting with the valve seat; and a fuel supply chamber between the valve housing and the valve needle;

wherein the outer surface of the housing joins the outer surface of the valve plate such that the surfaces of the valve housing and of the valve plate have a common, smooth, stepless, edgeless and at the same time curved surface in the closed state, and wherein a cone spray resulting at a transition of the housing and the valve plate when the valve is open intersects a tangent to the surfaces of the valve body and the valve plate facing the combustion chamber, vertically or virtually vertically at an angle of approximately 90°±20°.

15. The injection valve according to claim 14, wherein the curved surface of the injection valve is represented by means of a paraboloid, a hyperboloid or an ellipsoid, in particular a spherical cap.

16. The injection valve according to claim 15, wherein the front end of the injection valve is configured as blunt, for example with a paraboloid end, a hyperboloid end, an ellipsoid end or an end in the shape of a spherical cap.

17. The injection valve according to claim 14, wherein one or a plurality of curvature radii of the surface structure of the tip of the injection valve is smaller than the radius of the valve housing.

18. The injection valve according to claim 14, wherein the fuel supply chamber joins onto an outlet channel, which is bounded by the inner surface of the valve body and the inner surface of the valve plate.

19. The injection valve according to claim 18, wherein the outlet channel is configured such that the cross-section through which the fuel flows in the flow direction is constant or decreases.

* * * * *